US012588703B2

(12) United States Patent
Zhou

(10) Patent No.: US 12,588,703 B2
(45) Date of Patent: Mar. 31, 2026

(54) ELECTRONIC ATOMIZATION DEVICE AND ATOMIZER THEREOF

(71) Applicant: SHENZHEN SMOORE TECHNOLOGY LIMITED, Guangdong (CN)

(72) Inventor: Jianguang Zhou, Shenzhen (CN)

(73) Assignee: SHENZHEN SMOORE TECHNOLOGY LIMITED, Shenzhen (CN)

( * ) Notice: Subject to any disclaimer, the term of this patent is extended or adjusted under 35 U.S.C. 154(b) by 620 days.

(21) Appl. No.: 17/983,286

(22) Filed: Nov. 8, 2022

(65) Prior Publication Data

US 2023/0062960 A1 Mar. 2, 2023

Related U.S. Application Data

(63) Continuation of application No. PCT/CN2021/079491, filed on Mar. 8, 2021.

(30) Foreign Application Priority Data

May 11, 2020 (CN) ..... 202020770802.1

(51) Int. Cl.
*A24F 40/10* (2020.01)
*A24F 40/42* (2020.01)
*A24F 40/48* (2020.01)

(52) U.S. Cl.
CPC ..... *A24F 40/10* (2020.01); *A24F 40/42* (2020.01); *A24F 40/48* (2020.01)

(58) Field of Classification Search
None
See application file for complete search history.

(56) References Cited

U.S. PATENT DOCUMENTS

2016/0015081 A1 1/2016 Liu
2016/0249681 A1 9/2016 Liu
2019/0200673 A1* 7/2019 Bless ..... A24F 40/485

FOREIGN PATENT DOCUMENTS

CN 103355745 A 10/2013
CN 104323432 A 2/2015
(Continued)

OTHER PUBLICATIONS

Translation of CN105212278 (Year: 2016).*
(Continued)

*Primary Examiner* — Philip Y Louie
*Assistant Examiner* — Nicole A Szumigalski
(74) *Attorney, Agent, or Firm* — Leydig, Voit & Mayer, Ltd.

(57) ABSTRACT

A vaporizer includes: a liquid storage tube, an inner side wall of the liquid storage tube defining a liquid storage cavity for storing a vaporizable liquid substrate; a sleeve arranged in the liquid storage cavity, an accommodating cavity being arranged in the sleeve, the sleeve having a first surface and a second surface adjacent to the first surface in a circumferential direction, and at least one liquid guiding port on the first surface; a vaporization core arranged in the accommodating cavity for heating and vaporizing the vaporizable liquid substrate; and a seal member accommodated in the accommodating cavity and sandwiched between an outer wall of the vaporization core and a side wall of the sleeve, at least one liquid inlet hole that communicates the at least one liquid guiding port with the vaporization core being arranged in the seal member.

20 Claims, 8 Drawing Sheets

(56) References Cited

FOREIGN PATENT DOCUMENTS

| | | | | | |
|---|---|---|---|---|---|
| CN | 104970444 | A | | 10/2015 | |
| CN | 105212278 | A | * | 1/2016 | |
| CN | 207544340 | U | | 6/2018 | |
| CN | 208030279 | U | | 11/2018 | |
| CN | 209235010 | U | | 8/2019 | |
| CN | 209788471 | U | | 12/2019 | |
| WO | 2016115771 | A1 | | 7/2016 | |
| WO | WO-2020088602 | A1 | * | 5/2020 | ..... A24F 40/50 |

OTHER PUBLICATIONS

Patent Cooperation Treaty, International Search Report, International Application No. PCT/CN2021/079491 (Jun. 2, 2021).
Patent Cooperation Treaty, Written Opinion of the International Searching Authority, International Application No. PCT/CN2021/079491 (Jun. 2, 2021).

* cited by examiner

ELECTRONIC ATOMIZATION DEVICE AND ATOMIZER THEREOF

CROSS-REFERENCE TO PRIOR APPLICATION

This application is a continuation of International Patent Application No. PCT/CN2021/079491 filed on Mar. 8, 2021, which claims priority to Chinese Patent Application No. 202020770802.1 filed on May 11, 2020. The entire disclosure of both applications is hereby incorporated by reference herein.

FIELD

The present invention relates to the field of electronic vaporization technologies, and in particular, to an electronic vaporization device and a vaporizer thereof.

BACKGROUND

An electronic vaporization device mainly includes a vaporizer and a power supply component. The power supply component supplies power to the vaporizer, so that the vaporizer vaporizes a vaporizable liquid substrate to form a vapor. Generally, the vaporizer includes a liquid storage tube, a vaporization sleeve arranged in the liquid storage tube, and a vaporization core arranged in the vaporization sleeve. A liquid storage cavity is formed in the liquid storage tube. A hole is provided on the vaporization sleeve to communicate the liquid storage cavity with the vaporization core and to supply a liquid to the vaporization core. In order to miniaturize an electronic vaporization device, a liquid storage tube having a relatively small diameter may be designed. In order to obtain a relatively large amount of vapor, a diameter of a vaporization core may be designed to be relatively large. In order to realize both miniaturization and a relatively large amount of vapor, a distance between the vaporization core and a side wall of the liquid storage tube is usually designed to be relatively small. However, when a viscosity of a vaporizable liquid substrate to be vaporized by the electronic vaporization device is relatively large, the vaporizable liquid substrate cannot be smoothly absorbed by the vaporization core, resulting in an undesirable taste after vaporization by the electronic vaporization device.

SUMMARY

In an embodiment, the present invention provides a vaporizer, comprising: a liquid storage tube, an inner side wall of the liquid storage tube defining a liquid storage cavity configured to store a vaporizable liquid substrate; a sleeve arranged in the liquid storage cavity, an accommodating cavity being arranged in the sleeve, the sleeve having a first surface and a second surface adjacent to the first surface in a circumferential direction, and at least one liquid guiding port on the first surface; a vaporization core arranged in the accommodating cavity and configured to heat and vaporize the vaporizable liquid substrate; and a seal member accommodated in the accommodating cavity and sandwiched between an outer wall of the vaporization core and a side wall of the sleeve, at least one liquid inlet hole that communicates the at least one liquid guiding port with the vaporization core being arranged in the seal member, wherein a distance between the first surface and the inner side wall of the liquid storage tube opposite to the first surface is greater than a distance between the second surface and the inner side wall of the liquid storage tube opposite to the second surface.

BRIEF DESCRIPTION OF THE DRAWINGS

Subject matter of the present disclosure will be described in even greater detail below based on the exemplary figures. All features described and/or illustrated herein can be used alone or combined in different combinations. The features and advantages of various embodiments will become apparent by reading the following detailed description with reference to the attached drawings, which illustrate the following.

DETAILED DESCRIPTION

Figure 1:
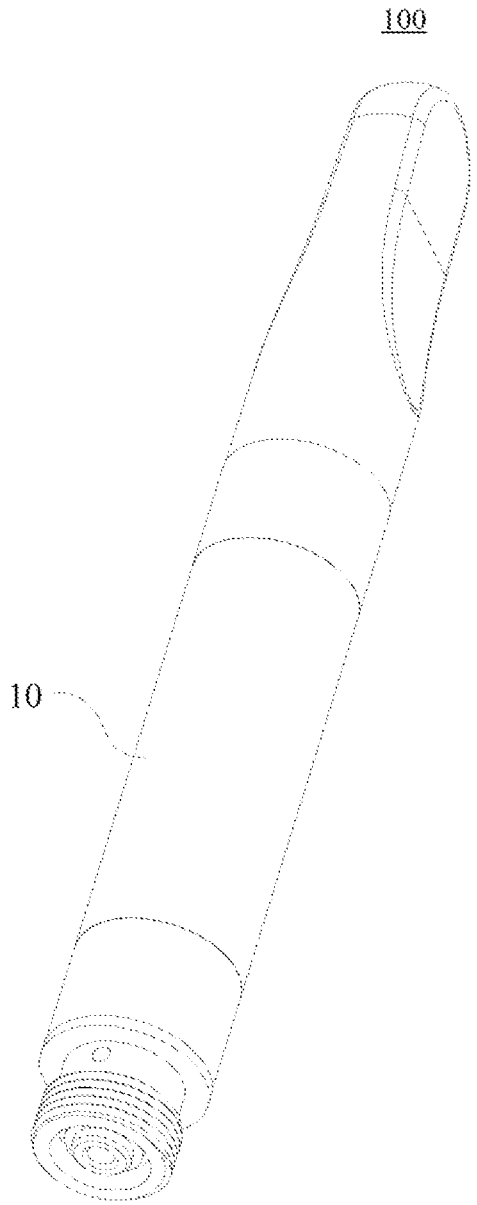
FIG. 1 is a three-dimensional schematic structural diagram of a vaporizer of an embodiment of the present invention.

In an embodiment, the present invention provides an electronic vaporization device and a vaporizer thereof, so as to resolve the technical problem in the prior art that a vaporization effect of a vaporizer is relatively poor.

In an embodiment, the present invention provides A vaporizer, including: a liquid storage tube, where an inner side wall of the liquid storage tube defines a liquid storage cavity configured to store a vaporizable liquid substrate; a sleeve, arranged in the liquid storage cavity, where an accommodating cavity is arranged in the sleeve, the sleeve has a first surface and a second surface adjacent to the first surface in a circumferential direction, and a liquid guiding port is provided on the first surface; a vaporization core, arranged in the accommodating cavity and configured to heat and vaporize the vaporizable liquid substrate; and a seal member, accommodated in the accommodating cavity and sandwiched between an outer wall of the vaporization core and a side wall of the sleeve, where a liquid inlet hole that communicates the liquid guiding port with the vaporization core is arranged on the seal member. A distance between the first surface and the inner side wall of the liquid storage tube opposite to the first surface is greater than a distance between the second surface and the inner side wall of the liquid storage tube opposite to the second surface.

The present invention provides an electronic vaporization device and a vaporizer thereof, so as to resolve the technical problem in the prior art that a vaporization effect of a vaporizer is relatively poor.

In order to resolve the foregoing technical problem, the present invention adopts a technical solution that is as follows: A vaporizer is provided, including: a liquid storage tube, where an inner side wall of the liquid storage tube defines a liquid storage cavity configured to store a vaporizable liquid substrate; a sleeve, arranged in the liquid storage cavity, where an accommodating cavity is arranged in the sleeve, the sleeve has a first surface and a second surface adjacent to the first surface in a circumferential direction, and a liquid guiding port is provided on the first surface; a vaporization core, arranged in the accommodating cavity and configured to heat and vaporize the vaporizable liquid substrate; and a seal member, accommodated in the accommodating cavity and sandwiched between an outer wall of the vaporization core and a side wall of the sleeve, where a liquid inlet hole that communicates the liquid guiding port with the vaporization core is arranged on the seal member. A distance between the first surface and the inner side wall of the liquid storage tube opposite to the first surface is greater than a distance between the second surface and the inner side wall of the liquid storage tube opposite to the second surface.

An orthographic projection of a side wall of the liquid guiding port on the seal member is located at a periphery of the liquid inlet hole.

The sleeve includes an accommodating portion and a smoke tube, the accommodating cavity is arranged in the accommodating portion, the smoke tube is in communication with the accommodating cavity, and a vapor vaporized by the vaporization core is discharged out of the accommodating cavity through the smoke tube.

The vaporization core is cylindrical, the accommodating portion is partially cylindrical, the vaporization core and the accommodating portion are coaxially arranged, a notch configured to communicate an outer peripheral surface of the accommodating portion with at least one end surface of the accommodating portion is arranged on the accommodating portion, and the first surface is a surface of the notch.

The first surface is a plane, and a distance between the first surface and an axis of the vaporization core is less than a radius of the accommodating cavity.

The first surface is a plane, a distance between the first surface and an axis of the vaporization core is less than a distance between the second surface and the axis of the vaporization core, and is greater than a radius of the accommodating cavity, and a cross-sectional size of the liquid guiding port is greater than a cross-sectional size of the liquid inlet hole.

A vaporization cavity is arranged in the vaporization core, the vaporizer further includes a heating element, and the heating element is arranged in the vaporization cavity, is in contact with a side wall of the vaporization cavity, and is configured to heat and vaporize the vaporizable liquid substrate on the vaporization core.

The seal member is sleeved on the outer wall of the vaporization core, and is in interference fit with the vaporization core.

The seal member includes a first seal portion and a second seal portion, the first seal portion is arranged on one end surface of the vaporization core, and is sandwiched between the end surface of the vaporization core and a top wall of the accommodating cavity, a first air guiding port in communication with the vaporization cavity is arranged on the first seal portion, and the second seal portion is sleeved on an outer peripheral wall of the seal member, and is sandwiched between a side wall of the vaporization core and a side wall of the accommodating cavity.

The seal member includes a third seal portion, the third seal portion is connected to the second seal portion and arranged on the other opposite end surface of the vaporization core, and a second air guiding port in communication with the vaporization cavity is arranged on the third seal portion.

A first annular rib is arranged on an outer end surface of the first seal portion, and the first annular rib is arranged around a periphery of the first air guiding port, and is sandwiched between an end surface of the first seal portion and a top wall of the accommodating cavity; and/or a second annular rib is arranged on an outer peripheral surface of the second seal portion, and the second annular rib is arranged along a circumferential direction of the seal member, is arranged on a side of the liquid inlet hole facing away from the first seal portion, and is sandwiched between the second seal portion and the side wall of the accommodating cavity.

An air inlet channel is arranged in the vaporizer, and a liquid absorbing member is arranged between the air inlet channel and the vaporization cavity.

The liquid absorbing member is connected to an end surface of the vaporization core close to the air inlet channel, and a vent hole in communication with the vaporization cavity is arranged on the liquid absorbing member.

The seal member is in interference fit with an inner wall of the accommodating cavity.

At least two liquid guiding ports are arranged, the at least two liquid guiding ports are evenly arranged at intervals on an outer side wall of the sleeve, two liquid inlet holes are arranged, and each of the liquid inlet holes is arranged corresponding to one of the liquid guiding ports.

In order to resolve the foregoing technical problem, the present invention adopts a technical solution that is as follows: An electronic vaporization device is provided, including a power supply component and the vaporizer described above. The power supply component is connected to the vaporizer for supplying power to the vaporizer.

The present invention has the following beneficial effects: Different from the prior art, in the embodiments of the present invention, the distance between the first surface and the inner side wall of the liquid storage tube is configured as being greater than the distance between the second surface and the inner side wall of the liquid storage tube, and the liquid guiding port is arranged in the first surface. In this way, a distance between the liquid guiding port and the inner side wall of the liquid storage tube can be increased, thereby enlarging a liquid feeding space. Therefore, a vaporizable liquid substrate having a relatively high viscosity can smoothly enter the liquid guiding port through a gap between the first surface and the inner side wall of the liquid storage tube, so as to supply a liquid to the vaporization core, thereby improving a vaporization effect of the vaporization core.

The following clearly and completely describes the technical solutions in the embodiments of the present invention with reference to the accompanying drawings in the embodiments of the present invention. Apparently, the described embodiments are only some of the embodiments of the present invention rather than all of the embodiments. All other embodiments obtained by a person of ordinary skill in the art based on the embodiments of the present invention without creative efforts shall fall within the protection scope of the present invention.

In this application, the terms "first", "second", and the like are intended to distinguish between different objects but do not indicate a particular order. In addition, the terms "include", "have", and any variant thereof are intended to cover a non-exclusive inclusion. For example, a process, method, system, product, or device that includes a series of steps or units is not limited to the listed steps or units; and instead, further optionally includes a step or unit that is not listed, or further optionally includes another step or unit that is intrinsic to the process, method, product, or device.

"Embodiment" mentioned in the specification means that particular features, structures, or characteristics described with reference to the embodiment may be included in at least one embodiment of this application. The term appearing at different positions of the specification may not refer to the same embodiment or an independent or alternative embodiment that is mutually exclusive with another embodiment. A person skilled in the art explicitly or implicitly understands that the embodiments described in the specification may be combined with other embodiments.

Figure 2:
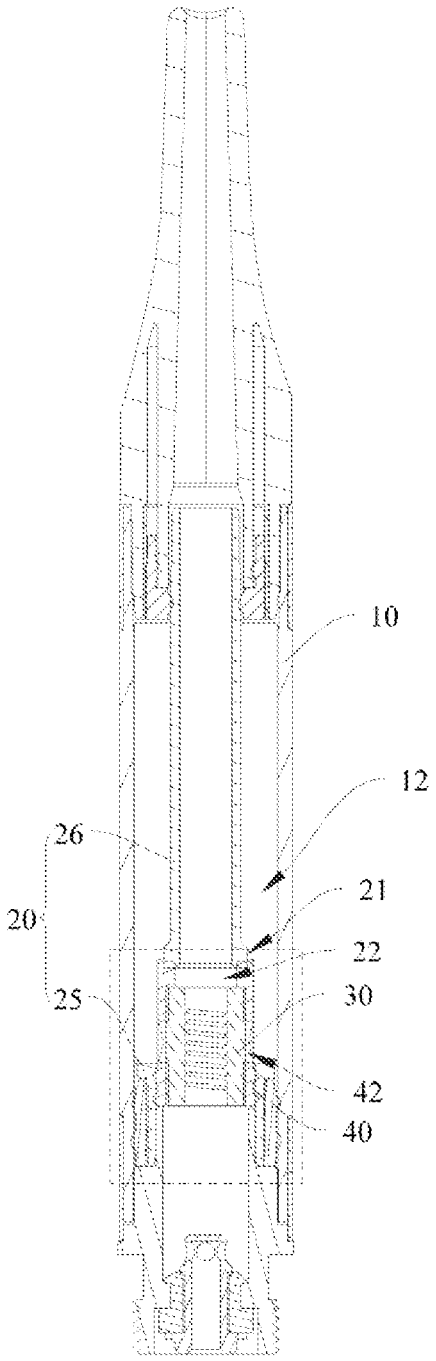
FIG. 2 is a schematic structural cross-sectional view of the vaporizer in FIG. 1.
Figure 3:
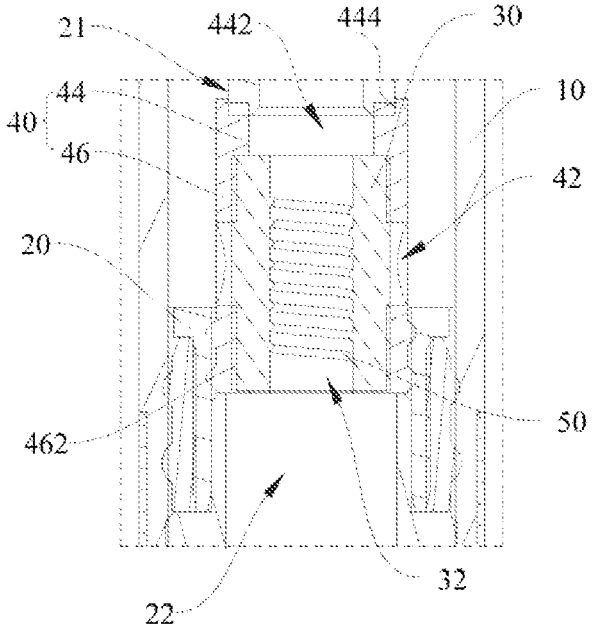
FIG. 3 is a partial enlarged schematic structural diagram of FIG. 2.
Figure 4:
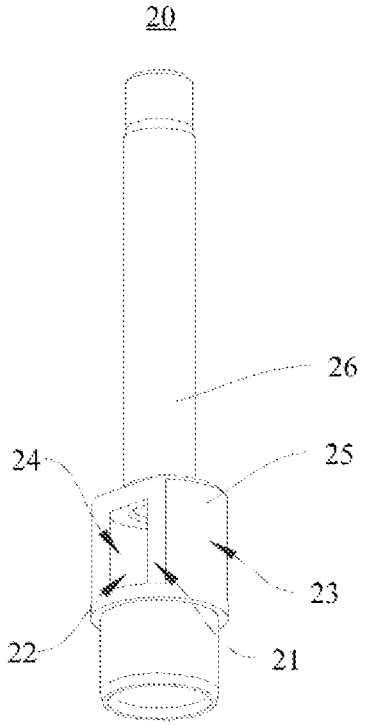
FIG. 4 is a three-dimensional schematic structural diagram of a sleeve in FIG. 2.

Referring to FIG. 1 to FIG. 4, FIG. 1 is a three-dimensional schematic structural diagram of a vaporizer of an embodiment of the present invention, FIG. 2 is a schematic structural cross-sectional view of the vaporizer in FIG. 1, FIG. 3 is a partial enlarged schematic structural diagram of FIG. 2, and FIG. 4 is a three-dimensional schematic structural diagram of a sleeve in FIG. 2. The present invention provides a vaporizer 100, including a liquid storage tube 10, a sleeve 20, a vaporization core 30, and a seal member 40. An inner side wall of the liquid storage tube 10 defines a liquid storage cavity 12 configured to store a vaporizable liquid substrate. The sleeve 20 is arranged in the liquid storage cavity 12, and an accommodating cavity 22 is arranged in the sleeve 20. The sleeve 20 has a first surface 21 and a second surface 23 adjacent to the first surface in a circumferential direction. A liquid guiding port 24 is provided on the first surface 21. The vaporization core 30 is arranged in the accommodating cavity 22 and configured to heat and vaporize the vaporizable liquid substrate. The seal member 40 is arranged in the accommodating cavity 22 and sandwiched between an outer wall of the vaporization core 30 and a side wall of the sleeve 20. A liquid inlet hole 42 that communicates the liquid guiding port 24 with the vaporization core 30 is arranged in the seal member 40. A distance between the first surface 21 and the inner side wall of the liquid storage tube 10 opposite to the first surface 21 is greater than a distance between the second surface 23 and the inner side wall of the liquid storage tube 10 opposite to the second surface 23.

Specifically, an outer peripheral surface of the sleeve 20 includes a first surface 21 and a second surface 23, the sleeve 20 is arranged in the liquid storage tube 10, and the outer peripheral surface of the sleeve 20 is arranged opposite to the inner side wall of the liquid storage tube 10. That is to say, the first surface 21 is arranged opposite to the inner side wall of the liquid storage tube 10, the second surface 23 is arranged opposite to the inner side wall of the liquid storage tube 10, and the distance between the first surface 21 and the inner side wall of the liquid storage tube 10 is greater than the distance between the second surface 23 and the inner side wall of the liquid storage tube 10. The vaporizable liquid substrate may be, for example, tobacco tar.

Specifically, an operating principle of the vaporizer 100 in this embodiment is as follows: The vaporizable liquid substrate in the liquid storage cavity 12 enters the liquid guiding port 24 through a gap between the first surface 21 and the inner side wall of the liquid storage tube 10, and then enters the liquid inlet hole 42 through the liquid guiding port 24, so that the vaporization core 30 contacts the vaporizable liquid substrate entering through the liquid inlet hole 42. The vaporization core 30 can vaporize the vaporizable liquid substrate to form a vapor when the vaporization core is heated.

In this embodiment of the present invention, the distance between the first surface 21 and the inner side wall of the liquid storage tube 10 is configured as being greater than the distance between the second surface 23 and the inner side wall of the liquid storage tube 10, and the liquid guiding port 24 is arranged on the first surface 21. In this way, a distance between the liquid guiding port 24 and the inner side wall of the liquid storage tube 10 can be increased, thereby enlarging a liquid feeding space. Therefore, a vaporizable liquid substrate having a relatively high viscosity can smoothly enter the liquid guiding port 24 through a gap between the first surface 21 and the inner side wall of the liquid storage tube 10, so as to supply a liquid to the vaporization core 30, thereby improving a vaporization effect of the vaporization core 30.

The terms "first", "second", and "third" in the present invention are merely used for description, and should not be understood as indicating or implying relative importance or implying a number of indicated technical features. Therefore, the features defined with "first", "second", and "third" may include at least one of the features explicitly or implicitly.

Further, an orthographic projection of the side wall of the liquid guiding port 24 on the seal member 40 may be arranged at a periphery of the liquid inlet hole 42. That is to say, the liquid inlet hole 42 arranged in the seal member 40 is located in a region defined by the liquid guiding port 24. On the one hand, the liquid inlet hole 42 can be prevented from being blocked by the liquid guiding port 24, so that the vaporizable liquid substrate can smoothly enter the liquid inlet hole 42 through the liquid guiding port 24. On the other hand, when the vaporization core 30 is heated, heat of the vaporization core 30 is conducted to the vaporizable liquid substrate located in the liquid storage cavity 12 through the seal member 40 and the sleeve 20, so as to preheat the vaporizable liquid substrate, to increase fluidity of the vaporizable liquid substrate, especially for a vaporizable liquid substrate having a relatively high viscosity, thereby facilitating liquid feeding. A size of the liquid guiding port 24 is configured as being greater than a size of the liquid inlet hole 42. In this way, thermal conductivity of the seal member 40 and the sleeve 20 can be increased, so that a temperature of the vaporizable liquid substrate is increased, and the fluidity is increased, thereby increasing a liquid feeding speed.

Alternatively, in other embodiments, the side wall of the liquid guiding port 24 and the side wall of the liquid inlet hole 42 may overlap. That is to say, a shape and the size of the liquid guiding port 24 are the same as a shape and the size of the liquid inlet hole 42.

Further, as shown from FIG. 2 to FIG. 4, the sleeve 20 includes an accommodating portion 25 and a smoke tube 26. The accommodating cavity 22 is arranged in the accommodating portion 25, the smoke tube 26 is in communication with the accommodating cavity 22, and a vapor vaporized by the vaporization core 30 is discharged out of the accommodating cavity 22 through the smoke tube 26.

In this embodiment, a cross-sectional size of the smoke tube 26 is less than a cross-sectional size of the accommodating cavity 22, so as to reduce a volume occupied by the smoke tube 26 in the liquid storage cavity 12. In this way, more vaporizable liquid substrates can be stored, and a service life of the vaporizer 100 is increased.

In another embodiment, the cross-sectional size of the smoke tube 26 may be greater than or equal to the cross-sectional size of the accommodating cavity 22, so that the vapor in the accommodating cavity 22 can be discharged out as soon as possible. Specifically, this may be flexibly configured as required.

Figure 5:
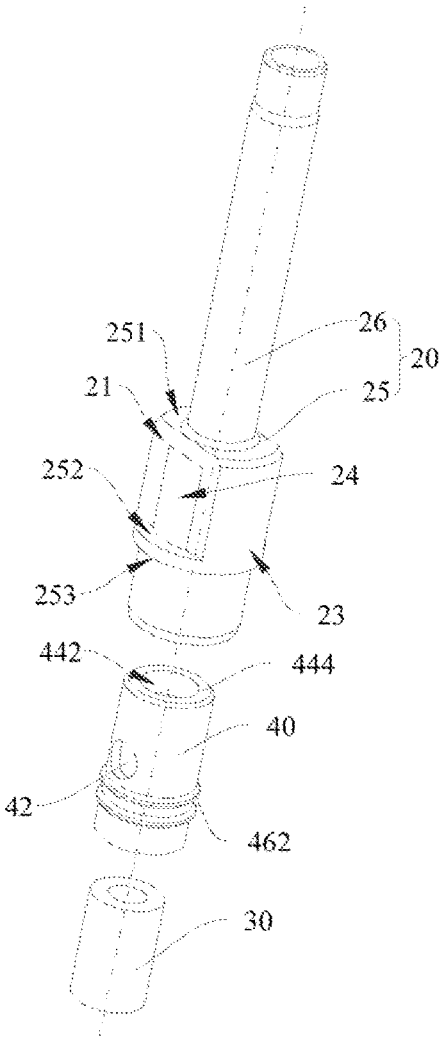
FIG. 5 is a schematic structural exploded view of partial elements of the vaporizer in FIG. 2.

Further, as shown in FIG. 5, FIG. 5 is a schematic structural exploded view of partial elements of the vaporizer in FIG. 2. The vaporization core 30 is cylindrical, the accommodating portion 25 is partially cylindrical, the vaporization core 30 and the accommodating portion 25 are coaxially arranged, a notch 252 configured to communicate an outer peripheral surface of the accommodating portion 25 with at least one end surface of the accommodating portion 25 is arranged on the accommodating portion 25, and the first surface 21 is a surface of the notch 252.

Specifically, in this embodiment, the accommodating portion 25 has an outer peripheral surface and a first end surface 251 and a second end surface 253 located on two opposite sides of the outer peripheral surface. The smoke tube 26 is arranged on the first end surface 251. The notch 252 extends from the first end surface 251, and cuts off a part of the outer peripheral surface of the cylindrical accommodating portion 25. The first surface 21 is a plane connected to the arcuate second surface 23 of the accommodating portion 25. In this way, when the sleeve 20 is arranged in the liquid storage tube 10, the notch 252 causes the distance between the first surface 21 and the inner side wall of the liquid storage tube 10 to be greater than the distance between the second surface 23 and the inner side wall of the liquid storage tube 10, so that the vaporizable liquid substrate in the liquid storage cavity 12 flows from the notch 252 to the liquid guiding port 24 and the liquid inlet hole 42.

Optionally, the second surface 23 may be arranged to abut against the inner wall of the liquid storage tube 10, and the first surface 21 may be arranged to be spaced from the inner wall of the liquid storage tube 10, which not only facilitate liquid feeding, but also increase a volume of the vaporization core 30, thereby increasing a vapor amount. Alternatively, the second surface 23 may be arranged to be spaced apart from the inner wall of the liquid storage tube 10.

Optionally, in an embodiment, a length by which the notch 252 extends from the first end surface 251 is less than a length of the accommodating portion 25 along an axial direction of the vaporization core 30, so as to form a step at an end of the accommodating portion 25 away from the first end surface 251. The step may abut against the inner wall of the liquid storage tube 10, and cover an opening of the liquid storage tube 10, so as to seal the liquid storage cavity 12.

Alternatively, in another embodiment, the length by which the notch 252 extends from the first end surface 251 may be equal to the length of the accommodating portion 25 along the axial direction of the vaporization core 30, so as to simplify a machining process of the notch 252. The length by which the notch 252 extends is not specifically limited in this embodiment of the present invention, which may be flexibly configured as required.

Figure 6:
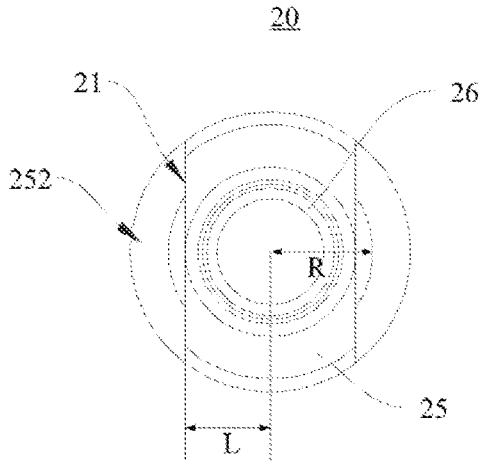
FIG. 6 is a planar schematic structural diagram of the sleeve in FIG. 5.

Further, in this embodiment, as shown in FIG. 5 and FIG. 6, FIG. 6 is a planar schematic structural diagram of the sleeve in FIG. 5. The first surface 21 is a plane, and a distance between the first surface 21 and an axis of the vaporization core 30 is less than a radius of the accommodating cavity 22. Specifically, in this embodiment, the radius of the accommodating cavity 22 is R, the distance between the first surface 21 and the axis of the vaporization core 30 is L, and L<R is set. Therefore, during the formation of the notch 252, the notch 252 can increase the distance between the outer side wall of the accommodating portion 25 and the inner side wall of the liquid storage tube 10, and the notch 252 can form, on the accommodating portion 25, a liquid guiding port 24 that communicates an outside of the accommodating portion 25 with an inner cavity. In this way, machining processes are reduced and production efficiency is improved. In addition, the size of the liquid guiding port 24 formed in this manner is relatively large, which not only helps the vaporizable liquid substrate enter the liquid inlet hole 42, but also increases a contact area between the seal member 40 and the vaporizable liquid substrate in the liquid storage cavity 12, thereby improving thermal conductivity.

In this embodiment, since the accommodating portion 25 is cylindrical, the notch 252 can form a rectangular liquid guiding port 24 by cutting the accommodating portion 25. Alternatively, in other embodiments, when the accommodating portion 25 is configured as other shapes, the notch 252 can form a liquid guiding port 24 with other shapes by cutting the accommodating portion 25. This is not specifically limited in this embodiment of the present invention.

Figure 7:
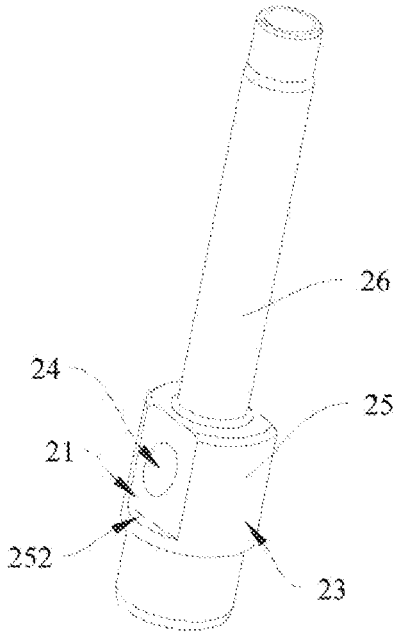
FIG. 7 is a three-dimensional schematic structural diagram of a sleeve of another embodiment of the present invention.
Figure 8:
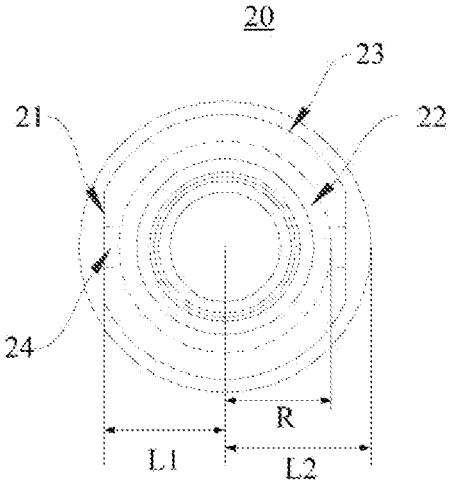
FIG. 8 is a planar schematic structural diagram of the sleeve in FIG. 7.

Alternatively, in another embodiment, as shown in FIG. 7 and FIG. 8, FIG. 7 is a three-dimensional schematic structural diagram of a sleeve according to another embodiment of the present invention, and FIG. 8 is a planar structure schematic structural diagram of the sleeve in FIG. 7. The first surface 21 is a plane, and a distance between the first surface 21 and an axis of the vaporization core 30 is less than a distance between the second surface 23 and the axis of the vaporization core 30, and is greater than a radius of the accommodating cavity 22. Specifically, in this embodiment, the radius of the accommodating cavity 22 is R, the distance between the first surface 21 and the axis of the vaporization core 30 is L1, and the distance between the second surface 23 and the axis of the vaporization core 30 is L2. By setting R<L1<L2, the distance between the first surface 21 and the inner wall of the liquid storage tube 10 can be increased while the notch 252 does not extend through the accommodating cavity 22 and communicate the inside with the outside of the accommodating cavity. In this case, the liquid guiding port 24 may be provided in the first surface 21. A cross-sectional size of the liquid guiding port 24 is greater than a cross-sectional size of the liquid inlet hole 42, to facilitate liquid feeding.

In an embodiment, as shown in FIG. 7, the liquid guiding port 24 on the first surface 21 is circular. When the liquid inlet hole 42 is circular, a center of the liquid guiding port 24 may be arranged to coincide with a center of the liquid inlet hole 42 on the seal member 40, and a diameter of the liquid guiding port 24 is greater than a diameter of the liquid inlet hole 42, so as to improve uniformity of the fluid feeding and increase an amount of guided fluid.

Alternatively, in other embodiments, the liquid guiding port 24 located on the first surface 21 may be a rectangular, a triangular, trapezoidal, or the like, which is not specifically limited in this embodiment of the present invention.

Further, as shown in FIG. 3, a vaporization cavity 32 is arranged in the vaporization core 30, and the vaporizer 100 further includes a heating element 50. The heating element 50 is arranged in the vaporization cavity 32, is in contact with a side wall of the vaporization cavity 32, and is configured to heat and vaporize the vaporizable liquid substrate in the vaporization core 30.

Specifically, in an embodiment, the vaporization cavity 32 extends through the vaporization core 30 along the axial direction of the vaporization core 30 to form a tubular vaporization core 30. The heating element 50 may be a helical heating wire. The heating wire is arranged in the vaporization cavity 32 and is in contact with the side wall of the vaporization cavity 32. When the vaporizable liquid substrate is conducted to the side wall of the vaporization cavity 32 through the vaporization core 30, the heating element 50 can heat and vaporize the vaporizable liquid substrate on the vaporization core 30 to form a vapor. The smoke tube 26 is in communication with the vaporization cavity 32. The vapor is discharged out of the vaporizer 100 through the smoke tube 26.

Optionally, in other embodiments, the heating element 50 may be a mesh heating element arranged on the side wall of the vaporization cavity 32. The structure of the heating element 50 is not specifically limited in this embodiment of the present invention.

In an embodiment, the seal member 40 is sleeved on the outer wall of the vaporization core 30, and the seal member 40 has an interference fit with the vaporization core 30, so that the seal member 40 can be connected to the vaporization core 30 more snugly. In this way, a sealing effect of the seal member 40 for the vaporization core 30 can be improved, thereby avoiding any liquid leakage, and can prevent the seal member 40 from moving by an acting force of the sleeve 20 on the seal member 40 during assembly of the sleeve 20, thereby facilitating assembly of the vaporization core 30 and the seal member 40 to the sleeve 20. In addition, the vaporization core 30 can be fixed in the sleeve 20 by applying the acting force of the seal member 40 to the vaporization core 30.

Optionally, as shown in FIG. 3, the seal member 40 includes a first seal portion 44 and a second seal portion 46. The first seal portion 44 is arranged on one end surface of the vaporization core 30, and is sandwiched between the end surface of the vaporization core 30 and a top wall of the accommodating cavity 22. A first air guiding port 442 in communication with the vaporization cavity 32 is arranged on the first seal portion 44. The second seal portion 46 is sleeved on an outer peripheral wall of the seal member 40, and is sandwiched between a side wall of the vaporization core 30 and a side wall of the accommodating cavity 22. The liquid inlet hole 42 is provided on the second seal portion 46.

Specifically, the first seal portion 44 is arranged on a side of the vaporization core 30 close to the smoke tube 26, and is sandwiched between the vaporization core 30 and the top wall of the accommodating cavity 22. Since the first air guiding port 442 is arranged on the first seal portion 44, the vaporization cavity 32 can be communicated with the smoke tube 26, thereby facilitating discharge of a vapor. Since the first seal portion 44 is arranged between the vaporization core 30 and the top wall of the accommodating cavity 22, a vapor liquid on the vaporization core 30 can be prevented from leaking into the smoke tube 26, which is discharged through the vaporizer 100 along with the vapor. The second seal portion 46 is sandwiched between the side wall of the vaporization core 30 and the side wall of the accommodating cavity 22. Since the second seal portion 46 is arranged between the side wall of the vaporization core 30 and the side wall of the accommodating cavity 22, the vapor liquid in the liquid storage cavity 12 can be prevented from leaking through a gap between the inner side wall of the accommodating portion 25 and the outer side wall of the vaporization core 30, thereby avoiding a liquid leakage.

Figure 9:
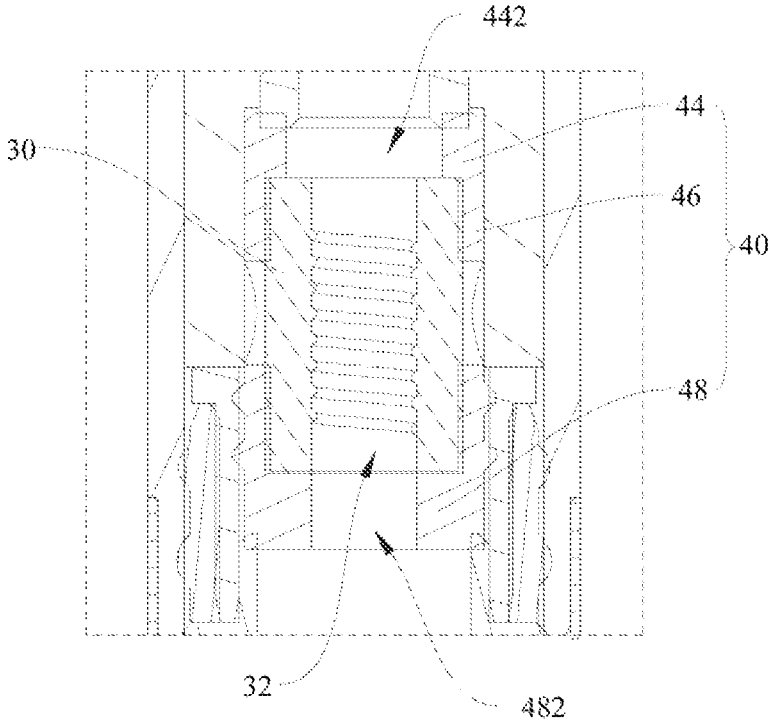
FIG. 9 is a partial enlarged schematic structural cross-sectional view of a vaporizer of another embodiment of the present invention.

Optionally, in an embodiment, as shown in FIG. 9, FIG. 9 is a partial enlarged schematic structural cross-sectional view of a vaporizer according to another embodiment of the present invention. The structure of the vaporizer 100 in this embodiment is substantially the same as the structure of the vaporizer 100 in the foregoing embodiment, except that in this embodiment, the seal member 40 further includes a third seal portion 48. The third seal portion 48 is connected to the second seal portion 46 and arranged on another opposite end surface of the vaporization core 30, and a second air guiding port 482 in communication with the vaporization cavity 32 is arranged on the third seal portion 48.

Specifically, the third seal portion 48 and the first seal portion 44 are respectively connected to two opposite sides of the second seal portion 46, and the third seal portion 48 and the first seal portion 44 are respectively configured to seal two opposite end surfaces of the vaporization core 30. A second air guiding port 482 is arranged on the third seal portion 48, so that outside air can enter the vaporization cavity 32, and take away the vapor in the vaporization cavity 32 under an inhaling force. The vaporizable liquid substrate in the vaporization core 30 is conducted to a bottom end surface of the vaporization core 30 under the action of gravity. Since the third seal portion 48 is arranged on the bottom end surface of the vaporization core 30, the vaporizable liquid substrate can be prevented from leaking through the bottom end surface of the vaporization core 30, thereby reducing a risk of a liquid leakage of the vaporizer 100.

The seal member 40 may be made of a flexible material such as silica gel or rubber, so as to facilitate assembly of the seal member 40 and the vaporization core 30. In addition, the first seal portion 44, the second seal portion 46, and the third seal portion 48 may be configured as an integrally formed structure, so as to simplify production and assembly processes, thereby improving production efficiency.

Further, as shown in FIG. 3 and FIG. 5, a first annular rib 444 is arranged on an outer end surface of the first seal portion 44. The first annular rib 444 is arranged around a periphery of the first air guiding port 442, and is sandwiched between an end surface of the first seal portion 44 and a top wall of the accommodating cavity 22. By arranging the first annular rib 444 between the first seal portion 44 and the top wall of the accommodating cavity 22, a gap between the first seal portion 44 and the top wall of the accommodating cavity 22 can be further reduced, thereby improving the liquid leakage prevention effect of the first seal portion 44.

In an embodiment, the first annular rib 444 may be integrally formed with the first seal portion 44. For example, the first annular rib 444 and the seal member 40 may be integrally formed by injection molding. In this way, strength of the connection between the first annular rib 444 and the first seal portion 44 is improved, and production and assembly processes are simplified, thereby improving production efficiency.

Alternatively, in another embodiment, the first annular rib 444 may be a ring washer. The ring washer is sandwiched between the first seal portion 44 and the top wall of the accommodating cavity 22. The ring washer may not be connected to the first seal portion 44. Alternatively, the ring washer may be connected to a surface of the first seal portion 44 facing away from the vaporization core 30 by bonding.

Further, as shown in FIG. 3 and FIG. 5, a second annular rib 462 is arranged on an outer peripheral surface of the second seal portion 46. The second annular rib 462 is arranged along a circumferential direction of the seal member 40. The second annular rib 462 is arranged on a side of the liquid inlet hole 42 facing away from the first seal portion 44, and is sandwiched between the second seal portion 46 and the side wall of the accommodating cavity 22. By arranging the second annular rib 462 between the outer side wall of the second seal portion 46 and the inner side wall of the accommodating cavity 22, a gap between the second seal portion 46 and the side wall of the accommodating cavity 22 can be further reduced, thereby improving a liquid leakage prevention effect of the second seal portion 46.

The second annular rib 462 may be integrally formed with the first seal portion 46. For example, the second annular rib 462 and the seal member 40 may be integrally formed by injection molding. In this way, strength of the connection between the second annular rib 462 and the second seal portion 46 is improved, and production and assembly processes are simplified, thereby improving production efficiency.

Optionally, in an embodiment, one second annular rib 462 may be arranged. The one second annular rib 462 is arranged on a side of the liquid guiding port 24 facing away from the first seal portion 44.

In another embodiment, as shown in FIG. 5, two second annular ribs 462 are arranged. The two second annular ribs 462 may be arranged at intervals along an axial direction of the seal member 40 to enhance a sealing effect of the second annular ribs 462, thereby avoiding a liquid leakage.

Further, the seal member 40 may be arranged to have an interference fit with the inner wall of the accommodating cavity 22, so as to ensure airtightness of the accommodating cavity 22, thereby preventing the vaporizable liquid substrate in the sleeve 20 from leaking through a gap between the seal member 40 and the side wall of the accommodating cavity 22. In addition, the seal member 40 may be fixed in the sleeve 20 by applying an acting force of the accommodating cavity 22 to the seal member 40.

Further, at least two liquid guiding ports 24 are arranged, the at least two liquid guiding ports 24 are evenly arranged at intervals on an outer side wall of the sleeve 20, two liquid inlet holes 42 are arranged, and each of the liquid inlet holes 42 is arranged corresponding to one of the liquid guiding ports 24.

In an embodiment, as shown in FIG. 3, two liquid guiding ports 24 are arranged, and the two liquid guiding ports 24 are arranged on two opposite sides of the sleeve 20 in a diameter direction. Two liquid inlet holes 42 are arranged, and each of the liquid guiding ports 24 is arranged corresponding to each of the liquid inlet holes 42. By arranging the liquid guiding ports 24 and the liquid inlet holes 42 in correspondence on two opposite sides of the vaporization core 30, the vapor liquid on the vaporization core 30 can be evenly distributed, thereby avoiding dry burning.

In another embodiment, three liquid guiding ports 24 are arranged, and the three liquid guiding ports 24 are evenly distributed at intervals along a circumferential direction of the sleeve 20. Three liquid inlet holes 42 are arranged, and each of the liquid guiding ports 24 is arranged corresponding to each of the liquid inlet holes 42. By arranging the plurality of liquid guiding ports 24, a liquid feeding speed can be further increased, and a vaporization effect of the vaporizer 100 can be enhanced.

Figure 10:
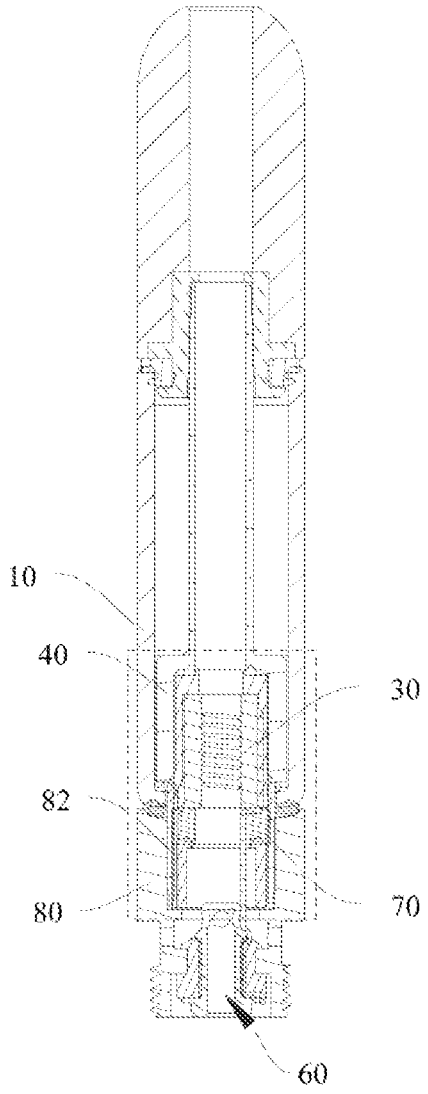
FIG. 10 is a schematic structural cross-sectional view of a vaporizer of still another embodiment of the present invention.
Figure 11:
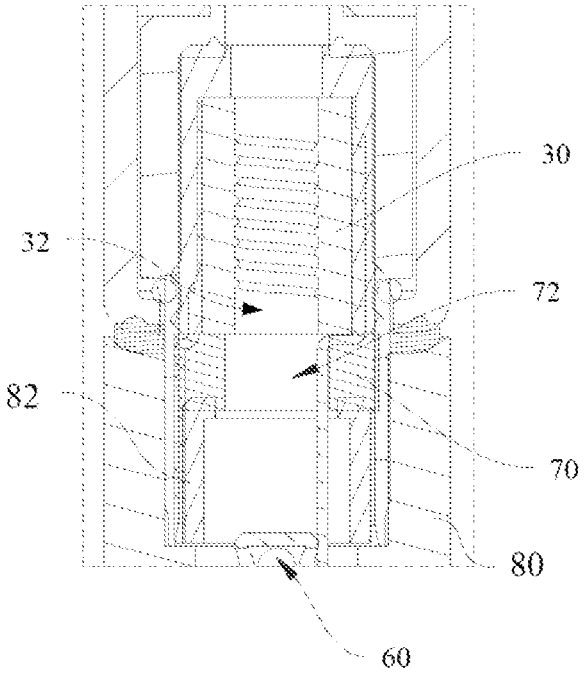
FIG. 11 is a partial enlarged schematic structural diagram of FIG. 10.

In other embodiments, as shown in FIG. 10 and FIG. 11, FIG. 10 is a schematic structural cross-sectional view of a vaporizer according to still another embodiment of the present invention, and FIG. 11 is a partial enlarged schematic structural diagram of FIG. 10. A structure of a vaporizer 100 in this embodiment is substantially the same as the structure of the vaporizer 100 shown in FIG. 2 and FIG. 3, except that in this embodiment, an air inlet channel 60 is arranged in the vaporizer 100, and a liquid absorbing member 70 is arranged between the air inlet channel 60 and the vaporization cavity 32. The air inlet channel 60 is in communication with an external environment, and external air enters the vaporization cavity 32 through the air inlet channel 60. The liquid absorbing member 70 is arranged between the air inlet channel 60 and the vaporization cavity 32. The vaporizable liquid substrate leaked through the vaporization core 30 can be absorbed by the liquid absorbing member 70, to prevent the vaporizable liquid substrate from leaking through the air inlet channel 60, thereby reducing a risk of a liquid leakage of the vaporizer 100.

The liquid absorbing member 70 may be made of nonwovens, sponge, or the like. This is not specifically limited in this embodiment of the present invention.

Further, as shown in FIG. 10 and FIG. 11, the liquid absorbing member 70 is connected to an end surface of the vaporization core 30 close to the air inlet channel 60, and a vent hole 72 in communication with the vaporization cavity 32 is arranged in the liquid absorbing member 70.

Specifically, the liquid absorbing member 70 maybe connected to the bottom end surface of the vaporization core 30, so that the liquid absorbing member 70 can fully absorb the vaporizable liquid substrate conducted to the bottom end surface of the vaporization core 30 through the vaporization core 30, thereby avoiding a leakage of the vaporizable liquid substrate on the vaporization core 30.

In an embodiment, as shown in FIG. 10 and FIG. 11, the vaporizer 100 may further include a base 80, and the base 80 is connected to a side of the liquid storage tube 10 facing the air inlet channel 60. A support post 82 is arranged on the base 80. When the base 80 is connected to the liquid storage tube 10, the support pillar 82 abuts against an end of the liquid absorbing member 70 facing away from the vaporization core 30, so that the liquid absorbing member 70 abuts against the vaporization core 30.

Alternatively, in another embodiment, the liquid absorbing member 70 may be connected to a surface of the vaporization core 30 by bonding, which is not specifically limited in this embodiment of the present invention.

Another embodiment of the present invention further provides an electronic vaporization device. The electronic vaporization device includes a power supply component and a vaporizer, and the power supply component is connected to the vaporizer for supplying power to the vaporizer.

A structure of the vaporizer in this embodiment is the same as the structure of the vaporizer 100 in the foregoing embodiment. Refer to the description in the foregoing embodiment, and the details are not repeated herein. The power supply component may be a primary battery or a recycled battery, which is not specifically limited in this embodiment of the present invention.

Based on the above, those skilled in the art can easily understand that, in this embodiment of the present invention, the distance between the first surface 21 and the inner side wall of the liquid storage tube 10 is configured as being greater than the distance between the second surface 23 and the inner side wall of the liquid storage tube 10, and the liquid guiding port 24 is arranged on the first surface 21. In this way, a distance between the liquid guiding port 24 and the inner side wall of the liquid storage tube 10 can be increased, thereby enlarging a liquid feeding space. Therefore, a vaporizable liquid substrate having a relatively high viscosity can smoothly enter the liquid guiding port 24 through a gap between the first surface 21 and the inner side wall of the liquid storage tube 10, so as to supply a liquid to the vaporization core 30, thereby improving a vaporization effect of the vaporization core 30.

The foregoing descriptions are implementations of the present invention, and the protection scope of the present invention is not limited thereto. All equivalent structure or process changes made according to the content of this specification and accompanying drawings in the present invention or by directly or indirectly applying the present invention in other related technical fields shall fall within the protection scope of the present invention.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A vaporizer, comprising:

a liquid storage tube, an inner side wall of the liquid storage tube defining a liquid storage cavity configured to store a vaporizable liquid substrate;

a sleeve arranged in the liquid storage cavity, an accommodating cavity being arranged in the sleeve, the sleeve having a first surface and a second surface adjacent to the first surface in a circumferential direction, and at least one liquid guiding port on the first surface;

a vaporization core arranged in the accommodating cavity and configured to heat and vaporize the vaporizable liquid substrate; and a seal member accommodated in the accommodating cavity and sandwiched between an outer wall of the vaporization core and a side wall of the sleeve, at least one liquid inlet hole that communicates the at least one liquid guiding port with the vaporization core being arranged in the seal member, wherein a distance between the first surface that comprises the at least one liquid guiding port and the inner side wall of the liquid storage tube opposite to the first surface is greater than a distance between the second surface having no liquid guiding port and the inner side wall of the liquid storage tube opposite to the second surface, such that the vaporizable liquid substrate in the liquid storage cavity enters the at least one liquid inlet hole of the seal member through the at least one liquid guiding port that is on the first surface of the sleeve to be in contact with the vaporization core.

2. The vaporizer of claim 1, wherein an orthographic projection of a side wall of the at least one liquid guiding port on the seal member is located at a periphery of the at least one liquid inlet hole.

3. The vaporizer of claim 1, wherein the sleeve comprises an accommodating portion and a smoke tube, the accommodating cavity is arranged in the accommodating portion, the smoke tube is in communication with the accommodating cavity, and a vapor vaporized by the vaporization core is discharged out of the accommodating cavity through the smoke tube.

4. The vaporizer of claim 3, wherein the vaporization core is cylindrical, the accommodating portion is partially cylindrical, the vaporization core and the accommodating portion are coaxially arranged, wherein a notch configured to communicate an outer peripheral surface of the accommodating portion with at least one end surface of the accommodating portion is arranged on the accommodating portion, and wherein the first surface is a surface of the notch.

5. The vaporizer of claim 4, wherein the first surface is a plane, and a distance between the first surface and an axis of the vaporization core is less than a radius of the accommodating cavity.

6. The vaporizer of claim 4, wherein the first surface is a plane, a distance between the first surface and an axis of the vaporization core is less than a distance between the second surface and the axis of the vaporization core, and the distance between the first surface and an axis of the vaporization core is greater than a radius of the accommodating cavity, and wherein a cross-sectional size of the at least one liquid guiding port is greater than a cross-sectional size of the at least one liquid inlet hole.

7. The vaporizer of claim 1, wherein a vaporization cavity is arranged in the vaporization core, and wherein the vaporizer further comprises a heating element arranged in the vaporization cavity and in contact with a side wall of the vaporization cavity, the heating element being configured to heat and vaporize the vaporizable liquid substrate.

8. The vaporizer of claim 7, wherein the seal member is sleeved on the outer wall of the vaporization core, and is in an interference fit with the vaporization core.

9. The vaporizer of claim 8, wherein the seal member comprises a first seal portion and a second seal portion, the first seal portion is arranged on one end surface of the vaporization core, and is sandwiched between the end surface of the vaporization core and a top wall of the accommodating cavity, wherein a first air guiding port in communication with the vaporization cavity is arranged on the first seal portion, and wherein the second seal portion is sleeved on an outer peripheral wall of the seal member and is sandwiched between a side wall of the vaporization core and a side wall of the accommodating cavity.

10. The vaporizer of claim 9, wherein the seal member comprises a third seal portion connected to the second seal portion and arranged on another opposite end surface of the vaporization core, and wherein a second air guiding port in communication with the vaporization cavity is arranged on the third seal portion.

11. The vaporizer of claim 9, wherein a first annular rib is arranged on an outer end surface of the first seal portion around a periphery of the first air guiding port and sandwiched between an end surface of the first seal portion and a top wall of the accommodating cavity, and/or wherein a second annular rib is arranged on an outer peripheral surface of the second seal portion, arranged along a circumferential direction of the seal member, and arranged on a side of the at least one liquid inlet hole facing away from the first seal portion, the second annular rib being sandwiched between the second seal portion and the side wall of the accommodating cavity.

12. The vaporizer of claim 7, wherein an air inlet channel is arranged in the vaporizer, and wherein a liquid absorbing member is arranged between the air inlet channel and the vaporization cavity.

13. The vaporizer of claim 12, wherein the liquid absorbing member is connected to an end surface of the vaporization core close to the air inlet channel, and wherein a vent hole in communication with the vaporization cavity is arranged in the liquid absorbing member.

14. The vaporizer of claim 1, wherein the seal member is in an interference fit with an inner wall of the accommodating cavity.

15. The vaporizer of claim 1, wherein the at least one liquid guiding port comprises at least two liquid guiding ports, the at least two liquid guiding ports being evenly arranged at intervals on an outer side wall of the sleeve, wherein the at least one liquid inlet hole comprises two liquid inlet holes, and each of the two liquid inlet holes is arranged corresponding to one liquid guiding port of the at least two liquid guiding ports.

16. The vaporizer of claim 1, wherein the second surface is arranged to abut against the inner wall of the liquid storage tube, and the first surface is arranged to be spaced from the inner wall of the liquid storage tube.

17. The vaporizer of claim 1, wherein the second surface is arcuate.

18. The vaporizer of claim 3, wherein the sleeve comprises a step at an end of the accommodating portion that is away from the smoke tube, and wherein the step abuts against the inner wall of the liquid storage tube.

19. The vaporizer of claim 1, wherein the at least two liquid guiding ports include a first liquid guiding port on the first surface and a second liquid guiding port on a third surface that is adjacent to the second surface in the circumferential direction, a distance between the first surface that comprises the first liquid guiding port and the inner side wall of the liquid storage tube being greater than a distance between the second surface and the inner side wall of the liquid storage tube, and a distance between the third surface that comprises the second liquid guiding port and the inner side wall of the liquid storage tube being greater than a distance between the second surface and the inner side wall of the liquid storage tube.

20. An electronic vaporization device, comprising:

a power supply component; and the vaporizer of claim 1, wherein the power supply component is connected to the vaporizer to supply power to the vaporizer.

* * * * *